US008413396B2

(12) United States Patent
Oliva et al.

(10) Patent No.: US 8,413,396 B2
(45) Date of Patent: Apr. 9, 2013

(54) SPLICE SYSTEM FOR CONNECTING REBARS IN CONCRETE ASSEMBLIES

(75) Inventors: Michael G. Oliva, Madison, WI (US); Lawrence C. Bank, Washington, DC (US)

(73) Assignee: Wisconsin Alumni Research Foundation, Madison, WI (US)

( * ) Notice: Subject to any disclaimer, the term of this patent is extended or adjusted under 35 U.S.C. 154(b) by 266 days.

(21) Appl. No.: 12/539,391

(22) Filed: Aug. 11, 2009

(65) Prior Publication Data

US 2011/0036049 A1 Feb. 17, 2011

(51) Int. Cl.
*E04C 3/00* (2006.01)
*E04C 1/00* (2006.01)

(52) U.S. Cl.
USPC ..... 52/309.1; 52/848; 403/305

(58) Field of Classification Search ..... 52/848; 403/305; 428/36.1, 36.3, 113
See application file for complete search history.

(56) References Cited

U.S. PATENT DOCUMENTS

| | | | | | |
|---|---|---|---|---|---|
| 532,902 | A | * | 1/1895 | Palmer | 428/113 |
| 2,843,153 | A | * | 7/1958 | Young | 285/112 |
| 3,167,882 | A | * | 2/1965 | Abbott | 264/426 |
| 3,552,787 | A | | 1/1971 | Yee | |
| 3,627,621 | A | * | 12/1971 | Mowers | 428/113 |
| 3,638,978 | A | * | 2/1972 | Guntermann | 403/267 |
| 4,032,688 | A | * | 6/1977 | Pall | 428/36.1 |
| 4,112,159 | A | * | 9/1978 | Pall | 428/36.1 |
| 4,347,090 | A | * | 8/1982 | Anderson et al. | 156/149 |
| 4,352,381 | A | * | 10/1982 | Provi | 30/308.1 |
| 4,525,916 | A | * | 7/1985 | Wuhrer | 29/446 |
| 4,627,212 | A | * | 12/1986 | Yee | 52/848 |
| 4,749,170 | A | * | 6/1988 | Ase | 264/256 |
| 5,046,878 | A | * | 9/1991 | Young | 403/13 |
| 5,048,441 | A | * | 9/1991 | Quigley | 114/90 |
| 5,110,644 | A | * | 5/1992 | Sparks et al. | 428/36.3 |
| 5,305,573 | A | | 4/1994 | Baumann | |
| 5,459,973 | A | | 10/1995 | Baumann | |
| 5,606,839 | A | * | 3/1997 | Baumann | 52/848 |
| 5,677,046 | A | * | 10/1997 | Fawley et al. | 428/295.4 |
| 5,876,553 | A | * | 3/1999 | Kaiser | 156/433 |
| 6,265,065 | B1 | * | 7/2001 | McCallion | 428/375 |
| 6,548,130 | B1 | * | 4/2003 | Corman | 428/34.1 |

(Continued)

FOREIGN PATENT DOCUMENTS

JP 63004158 A * 1/1988

OTHER PUBLICATIONS definition of fibrous, http://www.merriam-webster.com/dictionary/fibrous.*

(Continued)

*Primary Examiner* — Brian Glessner
*Assistant Examiner* — Joseph J Sadlon
(74) *Attorney, Agent, or Firm* — Boyle Fredrickson, S.C.

(57) ABSTRACT

A splice tube assembly and corresponding system for connecting multiple fiber-reinforced polymer rebars include a polymeric tube that is externally covered by a reinforcing layer to control radial expansion of grout within the polymeric tube and of the polymeric tube itself, and the polymeric tube may be internally provided with locking structures for mechanically interlocking with the grout, ensuring that the splice tube assembly functions as a unit for transferring loads from a first rebar, extending from a first end of the polymeric tube, to a second rebar, extending from a second end of the polymeric tube.

21 Claims, 3 Drawing Sheets

U.S. PATENT DOCUMENTS

| | | | | |
|---|---|---|---|---|
| 6,755,212 | B1 * | 6/2004 | Bissen et al. | 137/615 |
| 6,800,164 | B2 * | 10/2004 | Brandstrom | 156/166 |
| 6,832,458 | B2 | 12/2004 | Sander et al. | |
| 7,175,893 | B2 | 2/2007 | Coats et al. | |
| 7,824,751 | B2 * | 11/2010 | Lockwood et al. | 428/36.1 |
| 2003/0113495 | A1 * | 6/2003 | Janusson et al. | 428/36.1 |
| 2008/0302063 | A1 * | 12/2008 | Braasch et al. | 52/853 |
| 2011/0072745 | A1 | 3/2011 | Pantelides et al. | |

OTHER PUBLICATIONS

Splice Sleeve North America, Inc., How to do it in Precast . . . , Printout available through www.splicesleeve.com, May 2008.

Lawrence C. Bank, Composites for Construction: Structural Design with FRP Materials, Copyright 2006, Chapter 1, Wiley & Sons, Inc. Hoboken, New Jersey, USA.

Lawrence C. Bank, Composites for Construction: Structural Design with FRP Materials, Copyright 2006, Chapter 4, Wiley & Sons, Inc., Hoboken, New Jersey, USA.

Lawrence C. Bank, Composites for Construction: Structural Design with FRP Materials, Copyright 2006, Chapter 11, Wiley & Sons, Inc., Hoboken, New Jersey, USA.

Zhenyu Zhu, Stay-in-Place Fiber Reinforced Polyer Forms for Precast Modular Bridge Pier System, Nov./Dec. 2004, Journal of Composites for Construction @ ASCE, pp. 560-568.

Marijn R. Spoelstra, FRP—Confined Concrete Model, Aug. 1999, Journal of Composites for Construction, pp. 143-150.

Amir Mirmiran, Behavior of Concrete Columns Confined by Fiber Composites, Journal of Structural Engineering, May 1997, pp. 583-590.

Frieder Seible, Seismic Retrofit of RC Columns with Continuous Carbon Fiber Jackets, Journal of Composites for Constructions, May 1997, pp. 52-62.

* cited by examiner

SPLICE SYSTEM FOR CONNECTING REBARS IN CONCRETE ASSEMBLIES

STATEMENT REGARDING FEDERALLY SPONSORED RESEARCH OR DEVELOPMENT

This invention was made with government support under 0092-07-10 awarded by the U.S. Department of Transportation. The government has certain rights in the invention.

CROSS REFERENCE TO RELATED APPLICATION

BACKGROUND OF THE INVENTION

The present invention relates to hardware for connected reinforcement bars (i.e., rebars) to each other, and more particularly to hardware for connecting metallic rebars, fiber-reinforced polymer rebars, and/or other rebars, to each other.

Reinforced concrete is concrete in which rebars or fibers have been incorporated to strengthen the otherwise brittle concrete. Rebar is commonly made of carbon steel which is typically unfinished, but can be epoxy-coated, galvanized, or clad in stainless steel for use in corrosive environments. Fiber-reinforced polymer rebar is now also being used in high-corrosive environments. Without the added tensile strength provided by the rebars, many concrete structures would not be possible. Numerous structures and building components consist of reinforced concrete including: roads, bridges, slabs, walls, beams, columns, foundations, frames, and floor systems.

Reinforced concrete is often classified in two categories: pre-cast concrete and cast-in-place (or in-situ) concrete. Pre-cast concrete, which continues to grow in popularity, is formed in a controlled environment and then transported to the construction site and put in place. Conversely, cast-in-place concrete is poured-in-place into forms which are constructed on site, and then allowed to cure. The advantages of pre-cast concrete include improved material quality when formed in controlled conditions and the reduced cost and time of constructing forms for use with cast-in-place concrete. However, integrating and/or connecting pre-cast components require a reinforcement bar from each component to be connected together. Current splicing techniques include: welding, rebar overlap, or cast-iron connectors.

Pre-cast concrete structures provide significant advantages over cast-in-place structures, specifically in their ability to reduce construction times required; thus, reducing the overall cost of the structures. The significant disadvantage of precast concrete structures is in how to connect the precast members in a safe and efficient manner. Many pre-cast members used in construction are currently jointed by spliced steel reinforcing bars. These connections are susceptible to corrosion which could lead to deterioration of the strength of the structure. The primary cause of corrosion in steel joint connects is exposure to sodium chloride that is present in marine environments or de-icing salts that are applied to bridge decks and parking structures. Some steel bar splice couplers include NMB Splice-Sleeve® products, available from Splice Sleeve North America of Irvine Calif., and others. However, steel connectors, like cast-iron rebar connectors and all other metallic rebar connectors, can be rather heavy and bulky. Workers on jobsites are required to physically manipulate these heavy and bulky connectors while aligning pairs of rebar to be connected. This can, at times, prove tiring and frustrating for the workers that handle the metallic connectors. Additionally, at least some metallic connectors require complex casting and finish machining procedures for their production, which can render the metallic connectors relatively costly.

In recent years, there have been significant advancements and a general acceptance of the use of fiber-reinforced polymer materials in structural applications. The American Concrete Institute published a design manual for the use of fiber-reinforced polymer rebars as an alternative to conventional steel reinforcing rebars. Fiber-reinforced polymer materials have the potential to be viable alternatives to conventional steel joint connections because of their material properties that can give them a significant advantage over steel in terms of weight, durability, and corrosion resistance.

Despite best efforts, however, such fiber-reinforced polymer rebars have only been implemented in pre-cast concrete construction practices to a modest extent. A primary reason for the lack of implementation of fiber-reinforced polymer rebars in pre-cast concrete construction practices is that splicing or connecting multiple fiber-reinforced polymer rebars in such applications has proven frustrating or impractical. For example, none of the three typical rebar joinder techniques, (i) welding, (ii) rebar overlap, and (iii) cast-iron connectors, are well suited for use with fiber-reinforced polymer rebars. Welding is unfeasible, rebar overlap can require large overlapping segments which may be wasteful, and cast-iron connectors remain susceptible to corrosion in spite of the corrosion resistant qualities of the fiber-reinforced polymer rebars which frustrates many of the most desirable characteristics of the fiber-reinforced polymer rebars.

SUMMARY OF THE INVENTION

The present invention provides a corrosion resistant rebar splice system that is suitable for connecting multiple rebars, including steel or other metallic rebars, fiber-reinforced polymer rebars, and/or other rebars, to each other. In one embodiment, the system includes a non-metallic, e.g., polymeric tube, which extends over adjacent ends of aligned rebars. The polymeric tube may then be filled with cement grout, locking the grout and polymeric tube and rebars to each other. This provides a rebar system made at least partially from non-metallic, corrosion-resistant materials so that the rebar system can be used for reinforcing concrete while having a relatively long use life in highly corrosive environments. In some implementations, providing fiber-reinforced polymer rebars and splice joint connecting components that are made from substantially similar materials allows the various components of a polymer rebar system to, e.g., thermally expand or contract at substantially similar rates. In other implementations, the polymeric tubes are used to connect steel rebars without requiring users to manipulate heavy cast iron or other metallic splice couplers.

In a further embodiment, the splice joint at and within the polymeric tube has a tensile strength, an ultimate capacity, and an ultimate stress capacity that are at least as great as a piece of metallic rebars or fiber-reinforced polymer rebar alone. This allows the splice joint to be a relatively strong component within a rebar system used for reinforcing concrete.

Specifically then, the present invention provides a splice system for connecting or attaching metallic rebars or fiber-reinforced polymer rebars to each other that includes a polymeric tube with (i) an outer circumferential surface; (ii) an inner circumferential surface; and (iii) a cavity surrounded by the inner circumferential surface. A reinforcing layer covers at least part of the outer circumferential surface of the tube, and a metallic rebar or fiber-reinforced rebar extends axially into the tube. An embedment length is defined by the length of the rebar portion extending into the tube. The tube is filled with cement grout, thereby filling the cavity around the rebar with grout. Comparing the embodiment length of a particular rebar to its diameter, the embedment length may be greater than about 10 times the rebar diameter.

The rebars can be any conventionally sized and configured as metallic rebars or fiber-reinforced polymer rebars, e.g., #5 rebars having diameters of about 0.625 inch, #6 rebars having diameters of about 0.75 inch, #7 rebars having diameters of about 0.875 inch, optionally, other sizes, and they can extend into the polymeric tube with an embedment length of at least about 5 inches, 10 inches, 15 inches, and/or other embedment lengths.

Thus, it is an object of at least one embodiment of the invention to provide a splice system having a splice tube assembly with a polymeric tube that accepts ends of rebars and a volume of grout therein, defining an embedment length that is sufficiently large in magnitude when compared to a diameter of the rebar, providing a suitably large bonding surface area between the rebar and grout. By providing a sufficiently large embedment length and thus also a sufficiently large bonding surface area, instances of non-desired withdrawals of the rebar(s) from the tube, e.g., slip-type failures, can be reduced.

In a further embodiment, the polymeric tube has an inner circumferential surface that is provided with locking structures. The locking structures are configured to mechanically interface or interlock with the grout. The locking structures may be protrusions, for example, sand particles, embedded in resin or some adhesive that is applied to the inner circumferential surface of the polymeric tube, producing bumps or other surface irregularities inside the tube. The protrusions may also be annular rings or spiraling ledges extending from the tube inner circumferential surface. Furthermore, the locking structures may be depressions, for example, circular discrete depressions, or annular or spiraling grooves extending into the tube inner circumferential surface.

It is thus an object of at least one embodiment of the invention to provide a splice tube assembly with polymeric tube having internal locking structures. By providing interface structures within the tube for the grout to interlock with and/or into the grout remains longitudinally fixed within the tube, whereby the grout can serve at least partially as a force transfer medium, locking the rebars together and transmitting various forces therebetween, and thus allowing multiple sections of rebar to be connected lengthwise for joining multiple precast concrete structures.

In a yet further embodiment, the reinforcing layer reduces tendencies of radial expansion of the grout when the splice tube assembly is pulled in tension. Furthermore, the reinforcing layer can reduce tendencies of radial expansion of the polymeric tube that can be induced by changing temperatures of the splice tube assembly. The reinforcing layer may be a composite having a reinforcing material component and a resin or adhesive components. The reinforcing material components can be made of, e.g., glass and/or carbon fiber and can be configured as a fibrous strand(s) or a sheet-like mat made from such material(s). The reinforcing material component can be wound or applied in a single layer or multiple layers over the outer circumferential surface of the polymeric tube aligned in the same direction or in differing directions and crisscrossing or cross-wrapping each other.

It is thus another object of at least one embodiment to hold dimensions of a splice tube assembly relatively constant by confining the polymeric tube within a reinforcing layer that mitigates radial expansion of the tube. By restricting the polymeric tube's ability to radially expand, the splice tube assembly is less likely to damage its grout due to differing rates of expansion of the differing materials, thereby maintaining the integrity of the splice joint.

These particular objects and advantages may apply to only some embodiments falling within the claims and thus do not define the scope of the invention.

DETAILED DESCRIPTION OF THE PREFERRED EMBODIMENT

Figure 1:
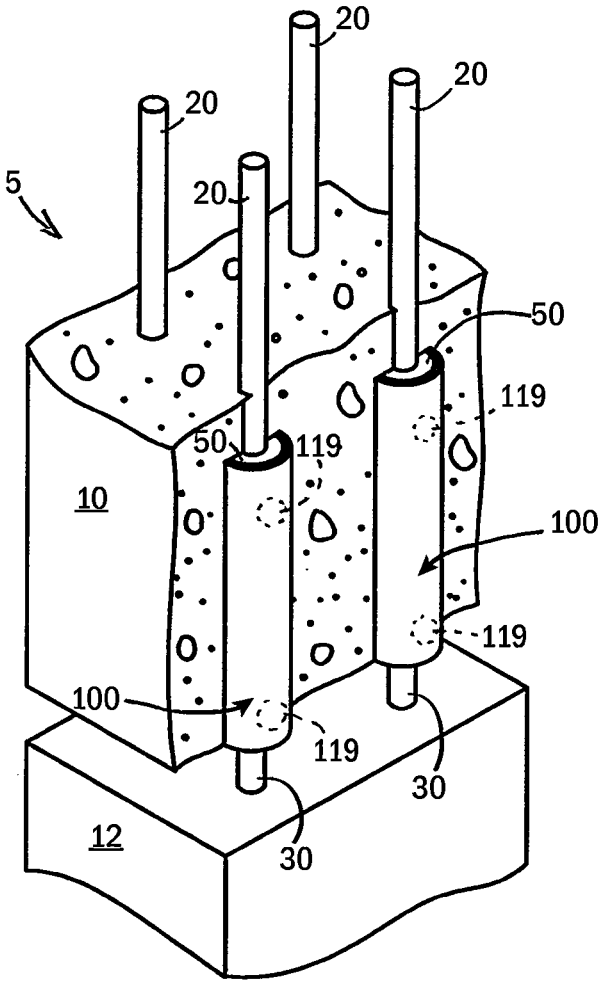
FIG. 1 is a pictorial view of precast concrete components incorporating a splice system of the invention.

Referring now to FIG. 1, the present invention provides a splice system for connecting metallic rebars or fiber-reinforced polymer rebars, e.g., system 5, which facilitates joining multiple precast concrete components together by utilizing at least some non-metallic materials in the various concrete reinforcing components.

System 5, as illustrated, is used for joining an upper precast concrete component 10 to a corresponding lower precast concrete component 12, both of which were cast, poured, or formed off site. Although upper and lower precast components 10, 12 are shown in a vertical arrangement, it is, of course, appreciated that the system 5 may be implemented for joining concrete components in any suitable arrangement that is dictated by design considerations of an end structure in which such concrete components are part(s).

Upper and lower precast concrete components 10, 12 include rebars 20, 30 that are cast thereinto. Rebars 20, 30 are made from any of a variety of suitable materials, including various metallic and non-metallic materials. The particular material(s) from which rebars 20, 30 are made are selected based on, for example, material performance characteristics and, in light of the intended end use environment, include anticipated stresses and forces that the concrete components 10, 12 and any spliced rebar joints will endure or be subjected to during use. Examples of suitable metallic materials for use in constructing rebars 20, 30 include, but are not limited to, various ferrous materials and alloys thereof such as steel, stainless steels, and/or others. Examples of suitable non-metallic materials for use in constructing rebars 20, 30 include, but are not limited to, various polymeric materials such as various of the polyolefins, and a variety of the polyethylenes, e.g., high density polyethylene, or polypropylenes, as well as various commodity polymers as polyvinyl chloride and chlorinated polyvinyl chloride copolymers, other "vinyl" materials, and/or a wide variety of the copolymers which embody any of the above-recited materials. Rebars 20, 30 can further include any of a variety of suitable reinforcing materials, such as various glass fibers, carbon fibers, aramid fibers, or other fibers and/or known non-fiber reinforcing materials that are suitable for reinforcing non-metallic (or metallic) rebars.

Regardless of the particular composition of rebars 20, 30, they can be cast within the concrete components 10, 12 so that they are generally aligned or registered with each other, allowing respective ones of them to be coupled, connected, or spliced by way of splice assemblies 100.

Still referring to FIG. 1, each splice tube assembly 100 is configured to connect and transfer loads and forces between the rebars 20, 30 so that the various advantages of rebar reinforcements to the individual concrete components 10, 12 are likewise utilized in the end assemblage or joined upper and lower concrete components 10, 12, without a weakened portion defined at that their intersection. The splice tube assembly 100 may be cast into a concrete component, e.g., upper concrete component 10. In this configuration, rebar 20 can be installed in the splice tube assembly 100, explained in greater detail elsewhere herein, and the rebar 20 and splice tube assembly 100 are placed in a form in which the upper concrete component 10 is cast.

For example, the splice tube assembly 100 can be positioned in the bottom of the form during the casting procedure so that a lower end opening of splice tube assembly 100 sits flush, is coplanar with, or is otherwise accessible from a lower wall or bottom of the upper concrete component 10. Rebars 30 are cast into the lower concrete component 12 so that they extend upwardly from and beyond an upper wall of the lower concrete component 12. Respective ones of rebars 20, 30 and splice assemblies 100 are aligned with each other, allowing the ends of rebars 30 to insert into the open ends of splice assemblies 100 for connecting the rebars 20, 30 and joining the upper and lower concrete components 10, 12 in the work field or on site.

Figure 2:
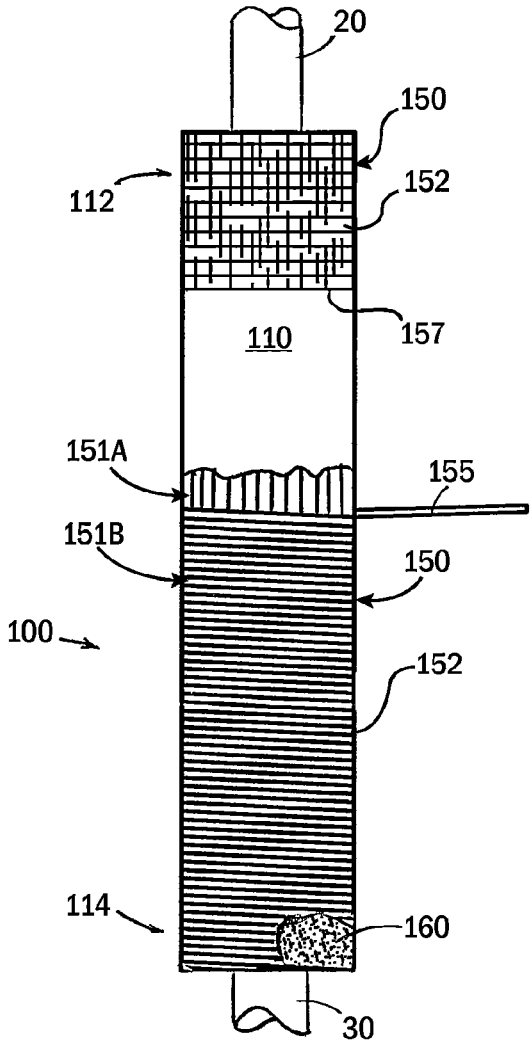
FIG. 2 is a top plan view of a splice tube assembly of the invention.
Figure 3:
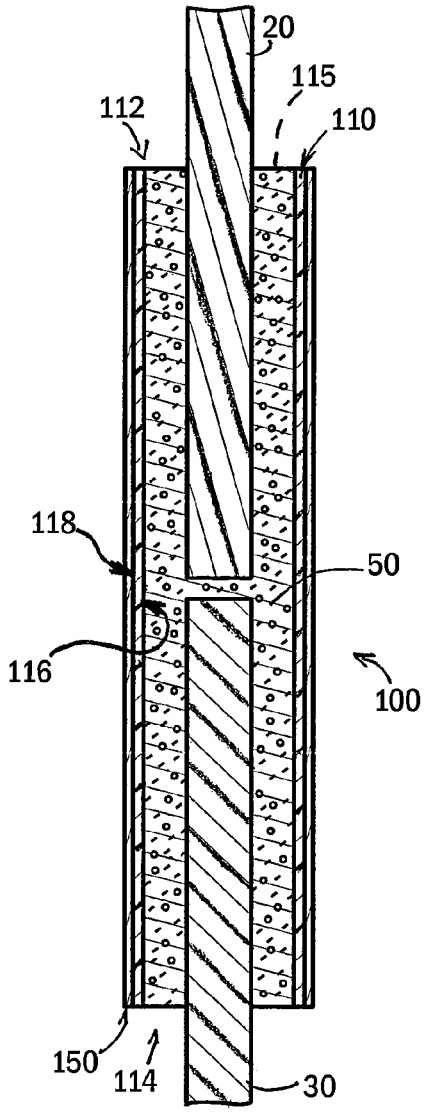
FIG. 3 is a cross-sectional view of the splice tube assembly of FIG. 2.
Figure 4:
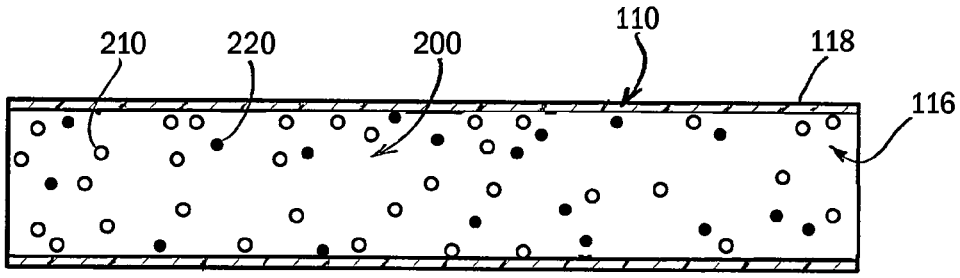
FIG. 4 is a cross-sectional view of a variant of the splice tube assembly of FIG. 2 with a first embodiment of a locking structure of the invention.

Referring now to FIGS. 2-4, each splice tube assembly 100 includes a polymeric tube 110, a reinforcing layer 150, and may also have one or more locking structures 200. Tube 110 can be made from any of a variety of suitable resins and/or polymeric materials. The particular polymeric materials are selected based on the intended end use characteristics of the splice tube assembly 100, as well as the intended end use environment. For example, each tube 110 may be an elongate pultruded or extruded member, optionally being made by way of various molding techniques and/or other commonly known plastics converting processes. Each tube can have a generally cylindrical configuration with a sidewall thickness of about ¼ inch, optionally other thicknesses, as desired, for example, less than about ¼ inch or greater than about ¼ inch, such as greater than about ⅜ or greater than about ½ inch. Tube 110 has first and second ends 112 and 114, a cavity 115 that can be filled with cement grout or mortar grout, e.g., grout 50, and opposing inner and outer circumferential surfaces 116 and 118. The particular type and configuration of grout 50 is selected based on the intended end-use structure and environment and can be any suitable cement, mortar, or other grout, be it expanding, non-expanding, minimally expanding, plasticized expanding, non-shrink, and/or others. One or more throughbores may extend through the sidewall of tube 110, allowing a user to fill the cavity 115 with grout 50 by pumping or otherwise conveying it through the throughbore(s) 119 either directly or by way of fill-ports that are connected to and extend from the tube 110, permitting remote access to the throughbore(s) 119 and thus also to the cavity 115.

Still referring to FIGS. 2-3, rebars 20 and 30 are housed concentrically within the tube 110, spaced radially from the inner circumferential surface 116 and spaced axially from each other, and are encased within grout 50 that occupies the void space of cavity 115. In this configuration, the grout 50 serves and an, e.g., adhesive or bonding agent that connects the rebars 20, 30 to each other and also connecting the rebars 20, 30 to the tube 110. This allows the assemblage of the rebars 20, 30, grout 50, and tube 110 to function as a substantially unitary structure. The distances that the rebars 20 and 30 extend into tube 110, namely, the distances between (i) tube end 112 and the end of rebar 20 and (ii) tube end 114 and the end of rebar 30, define embedment lengths of the rebars 20, 30. Bonding or adhesive characteristics between the rebars 20, 30 and grout 50 exist as a function of the surface area(s) of the rebars 20, 30 that is available for such bonding or adhesion.

In other words, the larger the surface area of rebars 20, 30 that can interface with grout 50, the greater the total bonding or adhesion performance will be between the rebars 20, 30 and grout 50. Thus, the bonding or adhesive characteristics between rebars 20, 30 and grout 50 are influenced by, e.g., the embedment lengths and the diameters of the rebars 20, 30. In some implementations, the relationship between rebar 20, 30 embedment length and diameter is such that the embedment length is greater than about 10 times the diameter of the rebar 20, 30. Notwithstanding, it is noted that the particular dimensions of the tube 110 are selected based at least in part on the intended end use environment and the configuration, size, dimensions, and material composition of rebars 20, 30 and the corresponding performance characteristics of the rebars 20, 30. Stated another way, embodiments of splice tube assembly 100 can incorporate (i) a relatively shorter tube 110 and implement shorter embedment lengths when using fiber reinforced (polymeric) rebars 20, 30, and (ii) a relatively longer tube 110 and implement longer embedment lengths when using steel or other metallic rebars 20, 30, for a give size of rebar. That is because for rebars 20, 30 of the same size, steel rebars typically have greater tensile strengths than non-metallic rebars. Correspondingly, to accommodate the greater transfers of force that will be exhibited through steel rebars 20, 30, splice tube assembly 100 includes a relatively longer tube 110 to cumulatively provide suitable force transfer capacity within the splice joint. The relatively longer tubes 110 used for connected steel rebars 20, 30 to each other accomplished this by spreading or distributing use-induced forces along their relatively greater lengths, thereby reducing the magnitudes of such force applications, per unit of length of the tubes 110, when compared to relatively shorter tubes 110 that can be used while implementing non-metallic rebars 20, 30.

As one example of such relationship, rebar 20, 30 can be a conventional #6 fiber-reinforced rebar having a nominal outer diameter of about 0.75 inch, and the rebar can have an embedment length of, for example, greater than about 5 inches or about 10 inches or more into the tube 110. As another example, rebar 20, 30 can be a conventional #6 steel rebar, again having a nominal outer diameter of about 0.75 inch, however, the embedment length can be about 10%, optionally, about 25% greater than required for the fiber reinforced rebar counterparts. Accordingly, in this example, the #6 steel rebar can have an embedment length of greater than about 5.5 inches (10% greater) or 11 inches (10% greater), optionally greater than about 6.25 inches (25% greater) or 12.5 inches (25% greater), when compared to the previous example. Such principles are equally applicable to other sizes of rebar, for example, #3, #4, #5, #7, #8, and/or others, whereby further examples need not be recited here while noting that tube 110 can be configured to accommodate any of the common rebar sizes.

It is noted that yet other embedment lengths are contemplated and well within the scope of the invention, noting that the particular embedment length, along with the relationship or ratio between the embedment length and the diameter of the rebar 20, 30. Preferably, the particular embedment length and/or relationship between embedment length and rebar diameter is selected to provide (i) adequate surface area of the rebars 20, 30 to which grout 50 adheres or bonds, with sufficient cumulative bonding force to prevent instances of non-desired withdrawals of the rebar 20, 30 from the tube 110 and thus prevent slip-type failures, (ii) sufficient force transfer capacity through the splice tube assembly 100 based on the material composition and performance characteristics of the rebar 20, 30, and (iii) other considerations such as, for example, available free space or clearances at the job site while connecting rebars 20, 30 to each other. Selecting suitable lengths for tubes 110 and embedment lengths for rebars 20, 30 can help ensure that rebars 20, 30 will remain encased in grout 50, such that various tensile and/or other loads and forces can be transferred from one of the rebars 20, 30 to the other one, through the grout 50 and tube 110. The integrity of this cooperative relationship between the rebars 20, 30, grout 50, and tube 110 may be enhanced by externally wrapping or covering the tube 110 with reinforcing layer 150.

Referring still to FIGS. 2-3, reinforcing layer 150 at least partially, preferably entirely, encapsulates the outer circumferential surface 118. This configuration provides biaxial/multi-axial strength for the splice tube assembly 100, enhancing the ability of splice tube assembly 100 to endure bending moments and/or other loading or unloading events that may include a tensile component, as well as other stresses and forces that must be endured by concrete structures. Reinforcing layer 150 is further configured to enhance axial force transfer performance along the length of tube 110, as well as oppose and mitigate radial expansion occurrences of, e.g., the rebars 20, 30, grout 50, and/or tube 110. Correspondingly, the reinforcing layer 150 provides supplemental longitudinal load transfer capability and structural integrity, as well as radially constricting the splice tube assembly 100, which, in combination, provides it with generally more stable and constant outer diameter and length dimensions. Such features correspondingly improve the force and load transfer characteristics between the rebars 20, 30. This can be accomplished by providing a reinforcing layer 150 that has a thickness dimension which is less than a thickness dimension of a sidewall of the tube 110, such that the reinforcing layer 150 does not unduly increase the overall diameter of the splice tube assembly 100. However, if desired, the reinforcing layer may be about the same thickness as, optionally thicker than, the sidewall of the tube 110.

Furthermore, by overcoming radial expansive and longitudinal elongation tendencies or occurrences of the splice tube assembly 100, reinforcing layer 150 prevents or reduces the likelihood of tube 110 cracking, breaking, or otherwise failing, whether it be from its own, that of grout 50, or another dimensional variation over time during use. Accordingly, reinforcing layer 150 imparts overall dimensional stability characteristics, particularly radial and longitudinal dimensional stability, to the splice tube assembly 100 during use, regardless of variations in environmental temperature, moisture contents, and/or other variable environmental factors.

As just one example, the reinforcing layer 150 can define a radial restraint or retaining force that is greater than an expansion force exerted by the non-metallic tube than can occur due to variations in ambient temperature. In some embodiments, the reinforcing layer 150 introduces a radial retaining force that can oppose thermally influenced dimensional changes of the tube 110 and/or grout 50 which occur as functions of their respective coefficients of thermal expansion, increasing the dimensional stability of the splice tube assembly 100 when compared to using just tube 110 alone. In other words, the reinforcing layer 150 enhances the tube's 110 ability to cooperate with grout 50 for transferring forces between the rebars 20, 30 by way of the multi-axial strength and resiliency it provides the splice tube assembly 100, and mitigating detrimental effects of ambient temperature variation. It is noted that reinforcing layer 150 can alternatively be placed as in inner layer inside of the tube 110, and reinforcing layer 150 need not be a layer per se, but rather can be integrated partially or wholly into the tube 110, as desired.

As examples of suitable configurations for providing such multi-axial strength or resiliency, reinforcing layer 150 may include both of (i) a longitudinal layer component 151A, extending generally longitudinally or along the length of tube 110, and (ii) a transverse layer component 151B, extending generally transversely with respect to the length of tube 110, e.g., circumferentially thereabout. In yet other implementations, the longitudinal and transverse layer components 151A, 151B are defined in combination by, e.g., randomly oriented discrete components which cumulatively provide the functionality of the longitudinal and transverse layer components 151A, 151B in combination.

Referring still to FIGS. 2-3, in general, the longitudinal component 151A may provide at least some longitudinal dimensional stability to the splice tube assembly 100, whereas the transverse component 151B may provide at least some radial dimensional stability thereto. Correspondingly, the longitudinal layer component 151A provides axially directed force transfer enhancements to the splice tube assembly 100, whilst the transverse layer component 151B provides radially-directed force transfer enhancements to or concentric restraint of the spice assembly 100.

The longitudinal and transverse layer components 151A, 151B can be arranged in any of a variety of suitable configurations within the reinforcing layer 150. For example, longitudinal and transverse layer components 151A, 151B can by arranged in concentrically layered relationship with respect to each other, interwoven with respect to each other, or either or both may be partially or wholly integrated into tube 110.

Referring yet further to FIGS. 2-3, any of the components of reinforcing layer 150, e.g., either or both of the longitudinal and transverse layer components 151A, 151B, may be a composite having a reinforcing material component 152 and a resin or adhesive component 160. Particularly regarding the reinforcing material component 152, it may be configured as a fibrous strand(s) 155, or a sheet-like mat 157, woven or nonwoven, or a unitary sleeve made from such mat 157. The fibrous strands 155 or mats 157 may include any of a variety of suitable fiber types, preferably glass fibers, KEVLAR® fibers, aramid fibers, and/or carbon fibers. For example, suitable reinforcing material components 152 include, but are not limited to, fiberglass sleeves sold under the trade name SILASOX which are available from A&P Technology, Inc. in Cincinnati, Ohio, fabrics sold under the trade name FORTASIL 1600, and fibrous strands sold under the trade name FLEXSTRAND ROVING, both available from Fiberglass Industries, Inc. in Amsterdam, N.Y., and others. The reinforcing material component 152 may extend along the length of, or be wound or wrapped tautly about the outer circumferential surface 118, using a filament winder or other suitable device depending on, e.g., whether the reinforcing material component 152 is fibrous strand 155 or mat 157, and the desired end orientation of the component 152. Preferably, the completed reinforcing layer 150 defines a multi-directional configuration with the longitudinal layer component 151A extending as discrete elements tightly adjacent each other and along the length of the tube 110, and the transverse layer component 151B in a tightly spiraling or concentric configuration so that it wraps circumferentially around the tube 110, generally perpendicularly with respect to a longitudinal axis of the tube.

Still referring to FIGS. 2-3, the reinforcing material component 152 may be applied in a single or multiple layers. For multiple layer implementations, such as those incorporating distinct longitudinal and transverse layer components, 151A, 151B, or in embodiments having multiple layers of each of the longitudinal and transverse layer components, 151A, 151B, the different layers may extend in differing directions so that they crisscross or cross-wrap over each other. Regardless of the particular winding or wrapping technique employed, at some point, the reinforcing material component 152 is coated with a resin or adhesive 160 which cures or dries to produce the tough and durable composite of reinforcing layer 150.

Furthermore, it is noted that the reinforcing layer 150, e.g., one or both of the longitudinal and transverse layer components 151A, 151B, can be applied to the outer circumferential surface 118 concurrently with the pultrusion, extrusion process that creates the tube 110, for example, by way of co-pultrusion, co-extrusion, and/or other suitable methods or techniques. Stated another way, either one of the longitudinal and transverse layer components 151A, 151B can be partially or wholly integrated into the tube 110, as desired. Regardless of the particular method(s) used to apply a layer of reinforcing layer 150 upon or into the tube 110, the reinforcing layer 150 restrains the tube 110 from non-desired radial and longitudinal expansion or elongation which, in turn, contributes to the grout 50 being held or restrained by the inner circumferential surface 116 of tube 110, enhancing the ability of the splice tube assembly 100 to transfer forces and loads between the rebars 20, 30.

Figure 5:
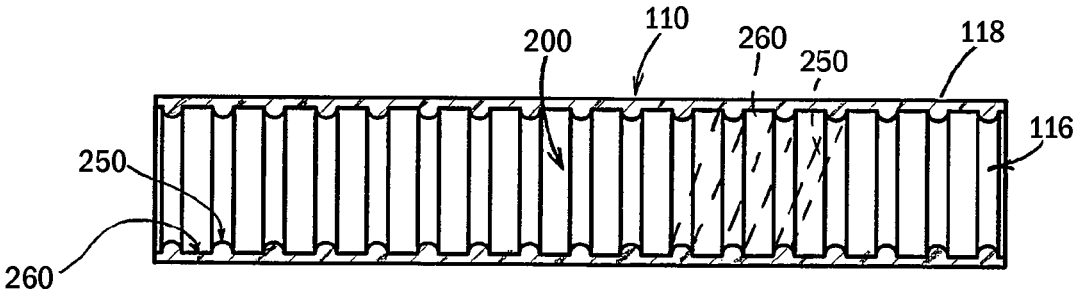
FIG. 5 is a cross-sectional view of a variant of the splice tube assembly of FIG. 4 with a second embodiment of a locking structure of the invention.

Referring now to FIGS. 4 and 5, the ability of tube 110 to hold grout 50 can be enhanced by providing any of a variety of locking structures 200 on the inner circumferential surface 116 to mechanically interface or interlock with grout 50. Namely, locking structures 200 provide an irregular or rough characteristic to the inner circumferential surface 116, whereby when grout 50 sets or dries, it correspondingly has an irregular or rough outer surface that is fit into the inside of tube 110. By mechanically interlocking grout 50 and tube 110, longitudinally directed and other forces, such as tensile forces, can be efficiently transferred along the length of tube 110 and between and through the various components of splice tube assembly 100.

Referring now to FIG. 4, locking structures 200 can be discrete depressions 210 or protrusions 220. For example, depressions 210 may be hemispherical or other, irregularly, shaped sunken voids or concavities. Protrusions 220 can be raised bumps or protuberances extending outwardly from the inner circumferential surface 116. One suitable method of forming protrusions 220 is by coating or otherwise treating the inner circumferential surface 116 with sand particles or other particulates that are suspended in a resin or adhesive carrier substance. This may provide a somewhat random texture to the inner circumferential surface 116.

Referring now further to FIG. 5, locking structures 200 define a relatively less random or consistently repeating pattern as compared to the sand particle treatment described above. For example, locking structures 200 may be defined by annular or spiraling rings or raised ledges, e.g., annular protrusions 250 that extend from the inner circumferential surface 116. In addition to or in lieu of annular protrusions 250, locking structures 200 may be defined by annular or spiraling grooves, e.g., annular depressions 260 that extend into the inner circumferential surface 116.

It is apparent that splice tube assembly 100 may be configured to avert or suitably control radial expansion of tube 110 and/or grout 50. Tube 110 is configured to cooperate with grout 50, fixedly holding grout 50 therein so that they tend to translate in unison with each other. This allows splice tube assembly 100 to effectively join multiple rebars 20, 30 to each other. Since at least some of the components of splice tube assembly 100, optionally, also rebars 20, 30, are made from non-metallic, non-corroding materials, system 5 can be suitably implemented in even harsh or highly corrosive environments while enjoying a suitably long use life and while providing relatively lightweight, easily manipulatable, and cost effective rebar splicing hardware or devices.

It is specifically intended that the present invention not be limited to the embodiments and illustrations contained herein and the claims should be understood to include modified forms of those embodiments including portions of the embodiments and combinations of elements of different embodiments as come within the scope of the following claims.

What we claim is:

1. A splice tube assembly for connecting rebars in a concrete assembly, the splice tube assembly comprising:

a tube that is made from a non-metallic material and has a sidewall and an elongate cavity open at both ends defined therein and that is sized to hold a volume of grout between an inner surface of the sidewall and a respective outer surface of a portion of at least one standard rebar for concrete use that can be held in the volume of grout within the tube; and a reinforcing layer that is made from a fibrous material and that engages the sidewall of the tube, the fibrous material including elongate strand segments of a different material than the non-metallic material of the tube, wherein the elongate strand segments are spaced from the volume of grout and engage the non-metallic material of the tube so as to be adapted to restrict radial expansion of the tube such that the tube after assembly with grout and the standard rebar remains intact without cracking during changes in at least one of temperature and loading of a concrete assembly in which the splice tube assembly is arranged.

2. The splice tube assembly of claim 1 wherein the sidewall of the tube defines a sidewall thickness dimension and the reinforcing layer defines a reinforcing thickness dimension that is smaller in magnitude than the sidewall thickness dimension.

3. The splice tube assembly of claim 2 wherein the strand segments of the fibrous material are provided upon an elongate fibrous strand that is wrapped about an outer circumferential surface of the sidewall of the tube such that the elongate fibrous strand is arranged generally perpendicularly with respect to a longitudinal axis of the tube.

4. The splice tube assembly of claim 3 wherein glass fibers define the elongate fibrous strand.

5. The splice tube assembly of claim 3 wherein carbon fibers define the elongate fibrous strand.

6. The splice tube assembly of claim 3 wherein the elongate fibrous strand includes at least one of an aramid fiber and a carbon fiber.

7. The splice tube assembly of claim 3 wherein the fibrous strand is wrapped in multiple layers over an outer circumferential surface of the sidewall of the tube.

8. The splice tube assembly of claim 7 wherein the multiple layers extend in different directions so that they crisscross with respect to each other.

9. The splice tube assembly of claim 2 wherein the strand segments of the fibrous material of the reinforcing layer are arranged in a mat wrapped about an outer circumferential surface of the sidewall of the tube.

10. The splice tube assembly of claim 9 wherein the mat includes glass fibers therein.

11. The splice tube assembly of claim 9 wherein the mat includes carbon fibers therein.

12. The splice tube assembly of claim 1 wherein the reinforcing layer defines a radial retaining force that is greater than an expansion force exerted by the tube and a volume of grout within the tube as a function of a coefficient of thermal expansion of the tube and the grout within the tube, such that during periods of changing temperatures, a maximum diameter of the splice tube assembly is influenced to a greater extent by the radial retaining force of the reinforcing layer than by the coefficient of thermal expansion of the tube and the grout within the tube.

13. A precast concrete system, comprising:

a tube defining a longitudinal axis and a first end and an opposing second end, the tube having, a circumferential sidewall that is made from a non-metallic material and that defines, an outer circumferential surface;

an inner circumferential surface; and a cavity surrounded by the inner circumferential surface of the circumferential sidewall;

a reinforcing layer that engages the circumferential sidewall and that is made from a fibrous material including elongate strand segments that are distinct from the non-metallic material of the circumferential sidewall; and that engage the material of the circumferential sidewall in a manner that is adapted to restrict radial expansion of the circumferential sidewall so as to substantially maintain a constant radial distance between the longitudinal axis and each of the outer and inner circumferential surfaces of the circumferential sidewall;

a precast concrete component that includes a matrix of concrete that surrounds the circumferential sidewall of the tube so that at least one of the first and second ends of the tube is accessible from outside of the precast concrete components;

a first rebar that is held in the precast concrete component and that extends at least partially into the first end of the tube and being spaced radially inward of the reinforcing layer; and a second rebar that can extend at least partially into the second end of the tube and being spaced radially inward of the reinforcing layer for joining the precast concrete component to another precast concrete component.

14. The splice system of claim 13 further comprising a volume of grout being provided within the cavity and interlocking the ones of the first and second rebars and the inner circumferential surface of the tube to each other.

15. The splice system of claim 14 wherein at least one of the first and second rebars is made from a material.

16. The splice system of claim 15 wherein at least one of the first and second rebars is made from a fiber-reinforced polymeric material.

17. The splice system of claim 14 wherein at least one of the first and second rebars is made from a metallic material.

18. The splice system of claim 17 wherein at least one of the first and second rebars is made from a steel material.

19. The splice system of claim 14 wherein the inner circumferential surface of the tube includes at least one locking structure that mechanically interlocks with the grout.

20. The splice system of claim 19 wherein the at least one locking structure includes sand particles that are attached to the inner circumferential surface of the tube.

21. A splice tube assembly for connecting rebars in a concrete assembly, the splice tube assembly comprising:

a tube that has a circumferential sidewall that is made from a non-metallic material and that defines a first coefficient of thermal expansion, a volume of grout being held concentrically inside of the circumferential sidewall of the tube and that has a second coefficient of thermal expansion such that the tube and grout undergo dimensional changes that correspond to changes in ambient temperature and which define an expansion force of the tube and grout; and a reinforcing layer that is made from a fibrous material that engages the circumferential sidewall of the tube and including elongate strand segments that are of a different material that the non-metallic material of the circumferential sidewall and that engage the non-metallic material of the circumferential sidewall so as to restrict radial expansion of the circumferential sidewall by way of the fibrous material undergoing relatively less dimensional change than either the tube or the grout during changes in ambient temperature so that the engagement of the fibrous material and the sidewall of the tube provides a restraint in a radial direction with respect to the tube that defines a retaining force of the reinforcing layer, the retaining force of the reinforcing layer being larger than the expansion force of the tube and grout so that dimensional changes of the tube and grout that correspond to changes in ambient temperature are restricted by the retaining force of the reinforcing layer so that the tube remains intact without cracking after assembly with grout during the changes in ambient temperature.

* * * * *